US006280365B1

(12) United States Patent
Weber et al.

(10) Patent No.: US 6,280,365 B1
(45) Date of Patent: Aug. 28, 2001

(54) ADJUSTABLE ASYMMETRIC-RESISTANCE UPPER BODY EXERCISER

(76) Inventors: Daniel J. Weber, 2444 Harriet Ave S., Minneapolis, MN (US) 55405; Jeffery A. Weber, 2614 Vincent Ave. N., Minneapolis, MN (US) 55411

( * ) Notice: Subject to any disclaimer, the term of this patent is extended or adjusted under 35 U.S.C. 154(b) by 0 days.

(21) Appl. No.: 09/497,041

(22) Filed: Feb. 2, 2000

Related U.S. Application Data

(60) Provisional application No. 60/118,374, filed on Feb. 3, 1999.

(51) Int. Cl.[7] ..... A63B 21/08
(52) U.S. Cl. ..... 482/124; 482/74
(58) Field of Search ..... 482/27, 124, 120, 482/115, 114, 125, 92, 116, 118, 72

(56) References Cited

U.S. PATENT DOCUMENTS

| | | | | |
|---|---|---|---|---|
| 4,441,707 | | 4/1984 | Bosch . | |
| 4,540,173 | | 9/1985 | Hopkins . | |
| 5,005,832 | * | 4/1991 | Van Der Hoeven | 482/124 |
| 5,129,647 | | 7/1992 | Castellanos | 482/124 |
| 5,141,223 | | 8/1992 | Block | 482/124 |
| 5,176,377 | * | 1/1993 | Wilkinson | 482/120 |
| 5,234,395 | | 8/1993 | Miller et al. | 482/118 |
| 5,328,432 | | 7/1994 | Gvoich | 482/118 |
| 5,433,688 | | 7/1995 | Davies | 482/124 |
| 5,618,249 | * | 4/1997 | Marshall | 482/127 |
| 5,792,034 | * | 8/1998 | Kozlovsky | 482/124 |
| 5,795,274 | * | 8/1998 | Kasbohm | 482/115 |
| 6,132,346 | * | 10/2000 | Weeks | 482/124 |

* cited by examiner

*Primary Examiner*—Jerome W. Donnelly
(74) *Attorney, Agent, or Firm*—Larkin Hoffman Daly & Lingren; John F. Klos

(57) ABSTRACT

A device for exercising a user's upper body, including a waist mountable assembly secured about the waist of the user, a frame member extending from the belt and including a proximal and a pair of distal ends, wherein the distal ends are located to the rear of the user and below a transverse plane of the user generally including the belt. A flexible cord member is associated with each distal end and coupled to a pair of hand attachment elements. A resistance force is transferred by the cord member for providing a force opposing exercise movement of each hand attachment means during use, the force generally directed to the associated distal end of an extending portion of the frame member during use.

16 Claims, 4 Drawing Sheets

ADJUSTABLE ASYMMETRIC-RESISTANCE UPPER BODY EXERCISER

CROSS REFERENCE TO RELATED APPLICATIONS

This application claims the benefit of priority pursuant to 35 USC §119(e)(1) from the provisional patent application filed pursuant to 35 USC §111(b): as Ser. No. 60/118,374 on Feb. 3, 1999.

TECHNICAL FIELD OF THE INVENTION

The present invention relates to an exercise device, and more particularly to an upper body exercise device including a belt portion that is worn about a user's waist.

BACKGROUND OF THE INVENTION

Devices and methods of use for exercising the upper body are well known. Many devices provide upper body exercise while the user is walking, running, or performing other physical activity. For many people, physical fitness activities include running, jogging, and skating, which are predominantly lower body intensive activities. Although these lower body intensive activities improve cardiovascular fitness and exercise the lower body, they fail to provide substantial exercise for the upper body. Equipment to be used during any of these lower body intensive activities must be easily portable.

Examples of such devices, include:

U.S. Pat. No. 5,328,432 to Gvoich which discloses an upper body exercising belt comprising a plurality of flexible housings having bores slidingly mounted on a waist-encircling belt, a flexible inelastic rope passing through a series of guide tubes mounted in the bores of the housings, and variable resistance means mounted to the bores;

U.S. Pat. No. 5,234,395 to Miller, et al. which discloses an adjustable asymmetric resistance upper body exercise device;

U.S. Pat. No. 4,441,707 to Bosch which discloses an exercise device including an elastic cord attached to a belt or other device worn at the waist of the user;

U.S. Pat. No. 5,129,647 to Castellanos which discloses an elastic resistance exercise device secured at the waist of the user;

U.S. Pat. No. 4,540,173 to Hopkins, Jr. which discloses a portable elastic exercising device having a single length of elastic cord passed through a flexible sheath to encompass a user's waist;

U.S. Pat. No. 5,509,873 to Corn which discloses an adjustable asymmetric resistance upper body exercise device;

U.S. Pat. No. 5,141,223 to Block which discloses an adjustable asymmetric resistance upper body exercise device; and U.S. Pat. No. 5,433,688 to Davies which discloses an adjustable asymmetric resistance upper body exercise device.

SUMMARY AND DESCRIPTION OF THE INVENTION

Addressing the deficiencies of the conventional art, the instant invention resolves the problems in an efficient, and cost effective manner. The instant invention, when used in conjunction with lower body activities, such as running, walking, in-line skating, etc., affords simultaneous exercise of both upper and lower body muscle groups. Beneficial aspects of this combined upper and lower body exercise are well appreciated, and include cardiovascular and overall musculature improvements.

One particular advantage of the exercise device of the present invention includes the provision of adjustable and even resistance throughout the entire range of motion of the user's arm. The adjustability of the resistance allows the user to select a different degree of difficulty from one workout to the next, or even to adjust the level of difficulty during the workout.

A further advantage of the present invention is the single point resistance adjustment device, which allows the user to quickly and efficiently adjust the level of resistance to arm motion.

Further advantages of the present invention include the provision of a resistive force which is nearly constant through a predetermined range of motion. The present invention additionally directs the resistive force opposing motion of the arm toward a point of origin which lies in a natural parallel sagittal plane including the user's shoulder. The point of origin is proximate to the natural, relaxed arm position at the side of the user. Resistance to motion of the arm thus is directed to a natural location, improving the comfort and efficiency of the exercise. In addition, the arm is subject to a force vector tending to direct the arm motion in a stress-efficient path of motion.

It is thus an object of the present invention to provide an exercise device that places the point of origin of all force vectors of the cords aligned in parallel saggital planes containing the user's shoulders and behind the user and below the users waist (proximate the natural, relaxed arm position of the hand).

Still other objects and advantages of the present invention and methods of construction of the same will become readily apparent to those skilled in the art from the following detailed description, wherein only the preferred embodiments are shown and described, simply by way of illustration of the best mode contemplated of carrying out the invention. As will be realized, the invention is capable of other and different embodiments and methods of construction, and its several details are capable of modification in various obvious respects, all without departing from the invention. Accordingly, the drawings and description are to be regarded as illustrative in nature, and not as restrictive.

DETAILED DESCRIPTION OF PREFERRED EMBODIMENTS

Figure 1:
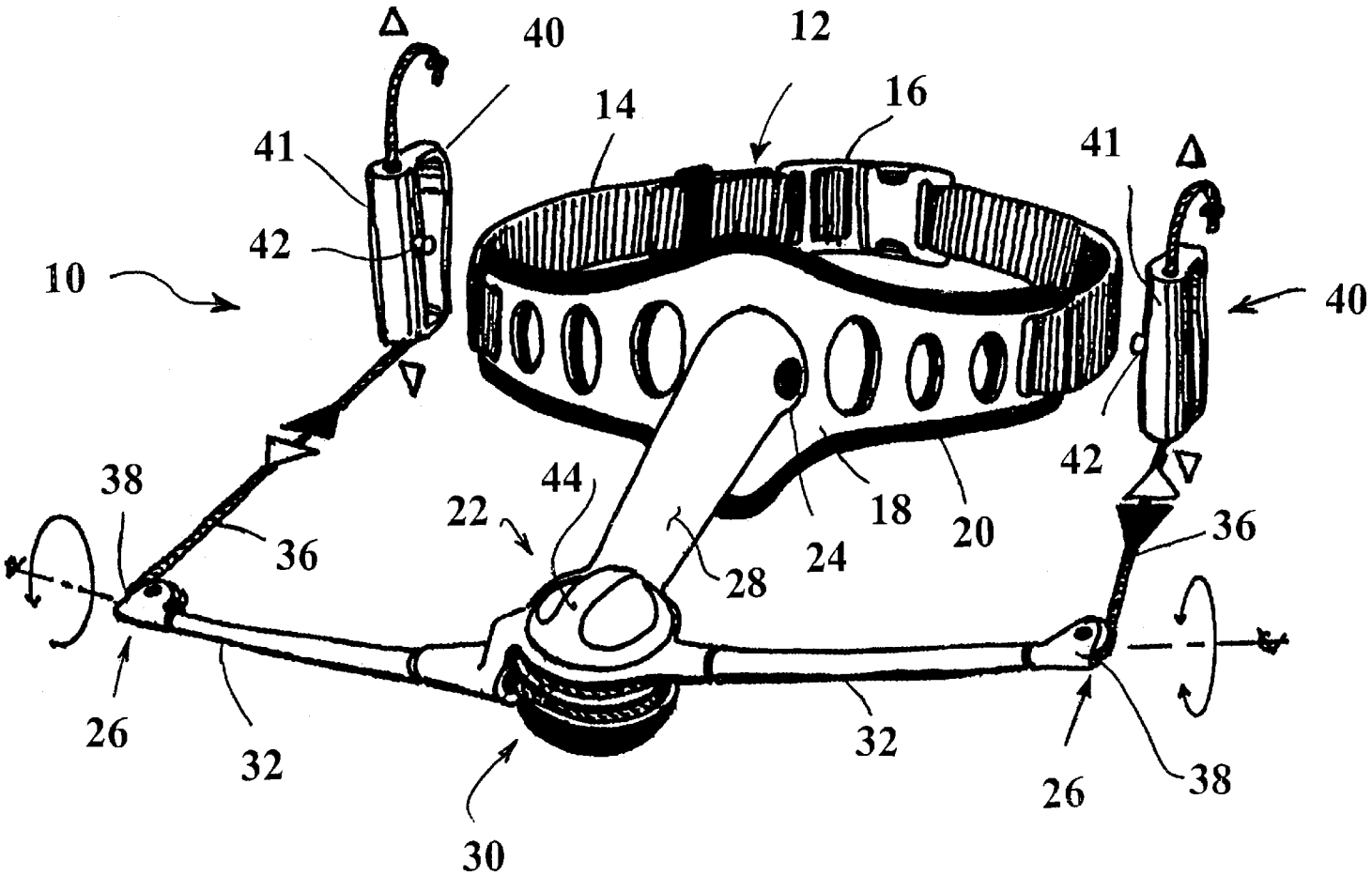
FIG. 1 is a perspective view of a upper body exercise device according to the present invention.

An exercise device according to the present invention is illustrated in FIGS. 1–5, as numeral 10. Exercise device 10 includes a belt assembly 12 including a belt 14 adapted to be secured about the waist of a user through a securement structure 16. Securement structure 16 may include alternative known approaches to coupling the belt assembly 12 to a user, e.g., belt fasteners and hook and loop fasteners such as Velcro®. As illustrated in FIGS. 2–7, the securement structure 16 is preferably disposed at the front side of the user. Opposite the securement structure 16 of the belt assembly 12 is a lumbar support member 18 which may include a foam element 20 for contacting the lumbar region of the user during device 10 usage. Together, the belt assembly 12, securement structure 16, and lumbar support member 18 encircle the waist of the user to couple the device 10 to the user during an exercise activity.

Lumbar support member 18 may be a substantially rigid element, being formed from a high density polymer material such as a reinforced fiber epoxy matrix. Disposed upon the rear side of the lumbar support member 18 is a frame member 22 being coupled to the lumbar support member 18 at a proximal end 24 and including a pair of distal ends 26. Frame member 22 includes a downwardly directed trunk element 28 and a variable tension mechanism 30. Frame member 22 further includes a pair of extension arm members 32 outwardly and transversely extending from the trunk element 28 toward distal ends 26. Extension arm members 32 are preferably hollow to operatively receive a cord 36 as described hereinafter. The length of the extension arm members 32 can be adjustable so that the user can determine the most comfortable or effective placement and direction of the frictional force developed by the device 10.

Disposed at the pair of distal ends 26 defined by the extension arm members 32 are a pair of pulleys 38. Pulleys 38 are swivelably coupled through a coupling 40 at or near the distal ends 26 of the extension arm members 32. A flexible, substantially nonstretchable cord 36 is threaded through the pulleys 38 and passes through the interior of the extension arm members 32. Additionally, flexible cord 36 is entrained about the variable tension mechanism 30 to provide a degree of resistive force during usage of the device 10. It is not critical that the cord 36 be reeved through pulleys 38 at the extreme ends of the extension arm members 32, as long as the cord 36 be generally freely slidable for movement in relation to the extension arm members 32. For example, the pulleys 36 may be replaced with polymer blocks or other low friction sliding surfaces.

Still referring to FIGS. 1–5, the flexible cord 36 is secured at either end to a hand coupling structure 40. Hand coupling structure 40 includes a rigid, substantially cylindrical hand grip element 41, though alternative hand coupling structures 40 may include flexible grips, etc. Hand coupling structures 40 each further include a cord length shortening device 42 which permits the user to adjust the cord 36 to a preferred length.

Preferably, the variable tension mechanism 30 provides an adjustable resistance force when the cords 36 are outwardly pulled by a user extending the hand coupling structure 40. The preferred variable tension mechanism 30 may vary the resistance force over a range of resistance forces, from substantially no resistance to a maximum resistance force using a tension adjustment knob 44. The preferred variable tension mechanism 30 provides an adjustable frictional force. Additionally, since forces of the user are transferred through the single cord 36, the user may practice the invention in a bi-directional resistance force mode by resisting the movement of opposite arm motions.

Figures 2, 3, 4:
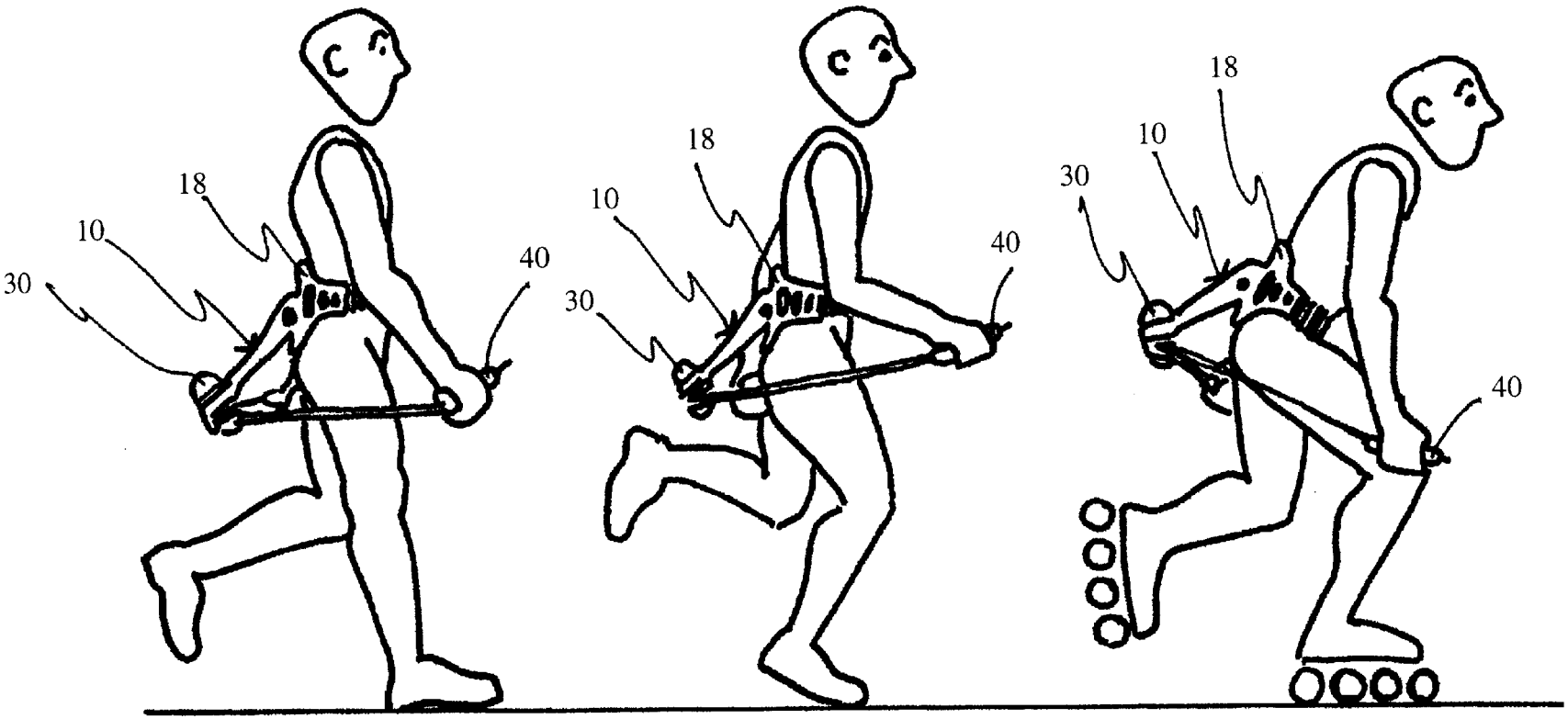
FIG. 2 is a diagrammatical view of the exercise device of FIG. 1 illustrating potential use of the device during a walking activity.
FIG. 3 is a diagrammatical view of the exercise device of FIG. 1 illustrating potential use of the device during a running activity.
FIG. 4 is a diagrammatical view of the exercise device of FIG. 1 illustrating potential use of the device during a inline skating activity.

Referring now to FIGS. 2–4, the invention may be practiced during a variety of well known recreational activities, such as walking depicted in FIG. 2, running as depicted in FIG. 3, or inline skating, as depicted in FIG. 4. It may be appreciated that the present invention may also be practiced while performing additional activities.

Figure 6:
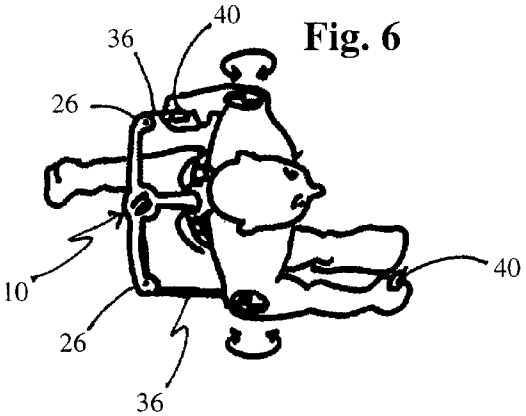
FIG. 6 illustrates a rear elevational view of the exercise device of FIG. 1, illustrating the desired orientation of the device relative to the user.
Figure 5:
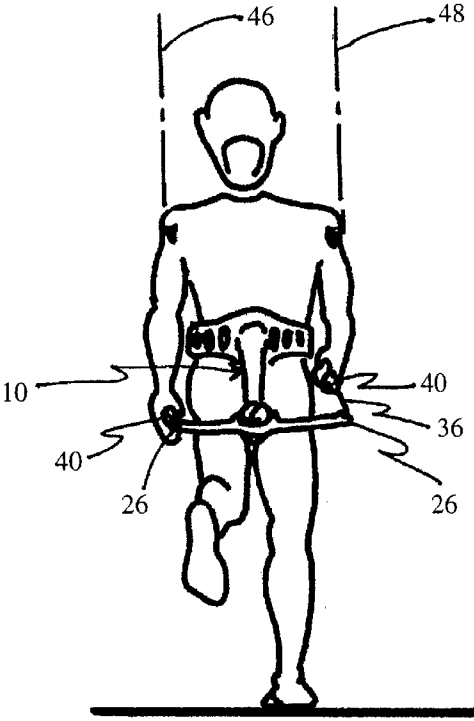
FIG. 5 illustrates a rear elevational view of the exercise device of FIG. 1, illustrating a desired orientation of the device relative to the user.

Referring now to FIGS. 5 and 6, shown is a rear elevational and top plan views, respectively, of the exercise device 10 as preferably associated with a user during exercise. As illustrated in FIG. 5, the distal end portions 26 of the extension arm members 32 are aligned in right and left parallel sagittal planes 46, 48 of the user. In one embodiment of the present invention, the extension arm members 32 may be telescopically coupled to the frame member 22 so that the length of the extension arm members 32 may be selectively adjusted so that the distal ends 26 are approximately equally spaced with the shoulder width of the user.

Figure 7:
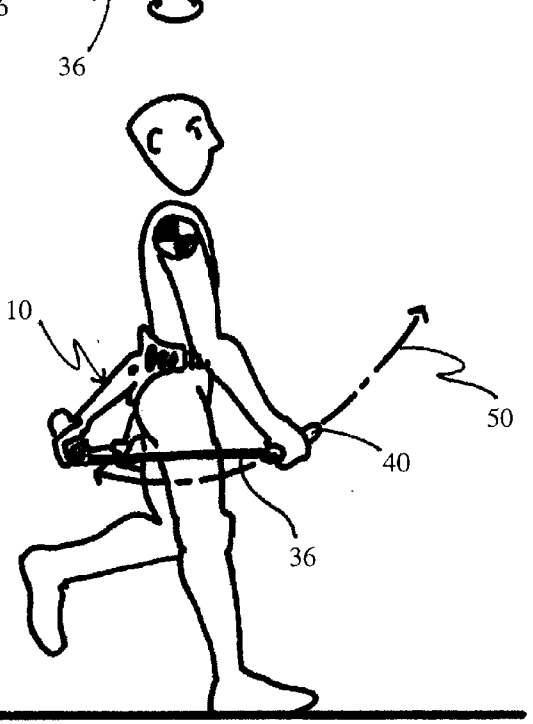
FIG. 7 illustrates a top plan view of the exercise device of FIG. 1, illustrating the desired orientation of the device relative to the user.

FIG. 7 illustrates a range of operational movement of the user's arm during exercise with the exercise device. 10 The range of motion 50 of the device is approximately defined as an arcuate portion of a normal arm swing movement, i.e., the normal arm swing motion of the user. The point of resistance provided by the exercise device is approximately the distal end 26 of the extension arm members 32 where the cord 36 is coupled. As illustrated, the distal end 26 is preferably approximately an arm length away from the user's shoulder.

Figure 8:
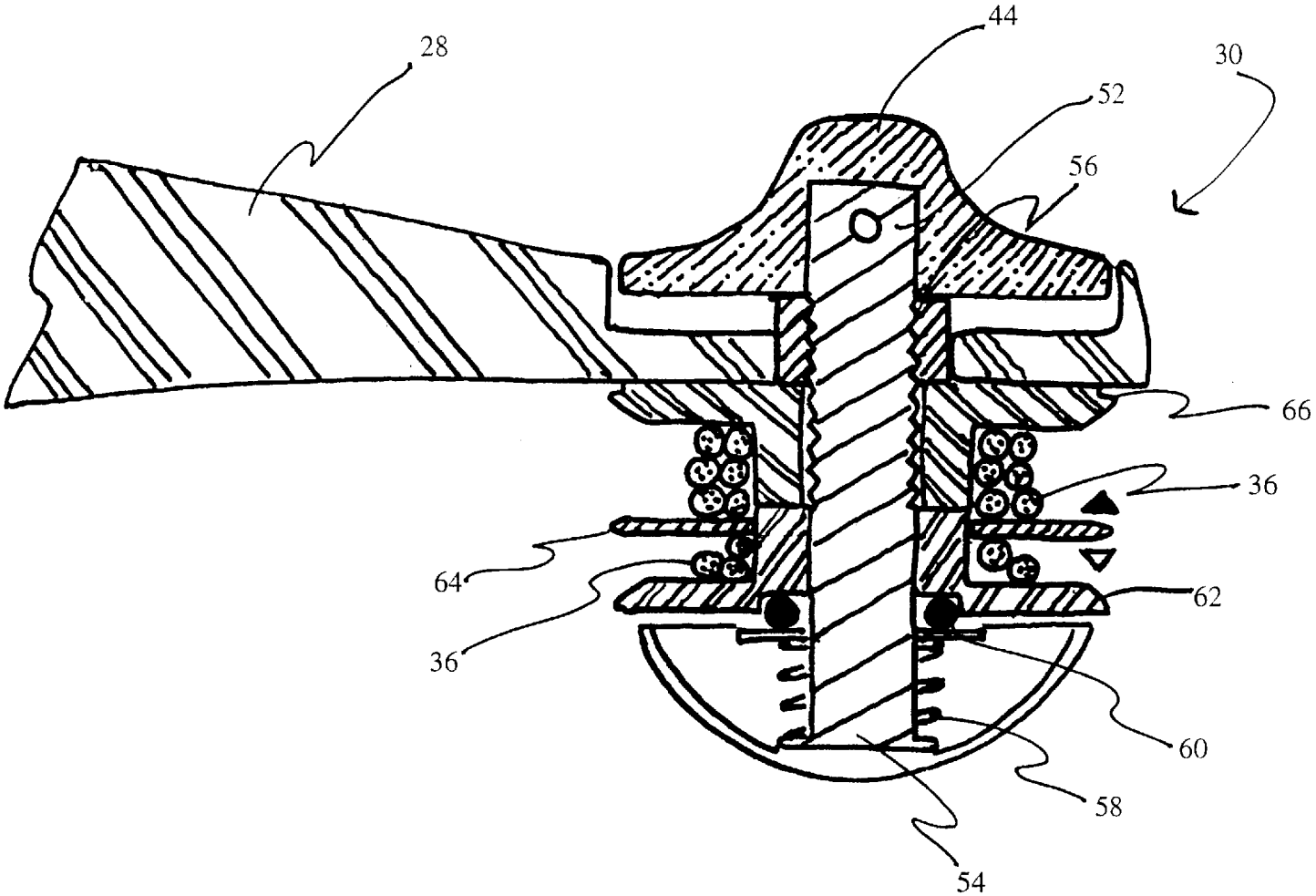
FIG. 8 is a detailed cross sectional view of the adjustable tension device.

Referring now to FIG. 8, a detailed cross sectional view of the adjustable tension device 30 is illustrated. Adjustable tension device 30 may be used to selectively control the frictional forces coupled through the flexible cord 36 to the user's arms. Adjustable tension device 30 includes a shaft 52 having a first end 54 and a second threaded end 56, a spring element 58, a thrust bearing element 60, a spool element 62 having an interiorly carried divider plate 64, a plurality of friction plates 66, and a knob 44 coupled with the second end 56 of the shaft 52. As knob 44 is tightened to draw closer the first end 54 of the shaft 52, an increasing frictional force is developed by the friction plates 66 to increase the resistive force of the exercise device 10. Divider plate 64 is slidably received within the spool 62 and functions to separate the differently directed portions of the cord 36 to minimize the opportunity for entanglement of the cord 36. Those skilled in the relevant arts will appreciate that a variety of approaches, designs, or techniques may be utilized to implement the adjustable tension device 30 of the present invention.

Other methods of construction and components are also envisioned. The above described embodiments of the invention are merely descriptive of the principles of the present invention and are not to be considered limiting. Further modifications of the invention herein disclosed will occur to those skilled in the respective arts and all such modifications are deemed to be within the scope of the invention.

We claim:

1. An improved exercise device comprising:

a belt for encircling a waist of a user;

a securement device selectively retaining the belt about the waist of the user;

a frame member extending from the belt and including a proximal end and a pair of distal ends, wherein the distal ends are located to the rear of the user and below a transverse plane of the user generally including the belt;

a flexible cord member associated with each distal end;

a pair of hand coupling structure for coupling the cord member to hands of the user;

a variable tension device operatively cooperating with the cord member for providing forces opposing exercise movement of each hand coupling structure during use; and a low friction member positioned on the frame member near each distal end forming a path for the cord member, whereby the forces are generally directed to the distal ends of the extending frame member during use.

2. An improved exercise device according to claim 1, wherein the belt further comprises a front portion and a rear portion relative to the forward movement of the user, and wherein the frame member is attached to and extends from the rear portion of the belt.

3. An improved exercise device according to claim 2, wherein the frame member further comprises a back plate proximate the proximal end, and wherein the back plate is generally against the lumbar region of the user.

4. An improved exercise device according to claim 2, wherein the frame member is T-shaped including a central downwardly angled trunk member and a right and left transverse extension arm member, and wherein right and left distal ends are generally horizontally opposed at outer portions of the extension arm members.

5. An improved exercise device according to claim 4, wherein the trunk member is angled downwardly from the transverse plane at approximately 10–30 degrees and wherein the distal ends are approximately 4–10 inches below the transverse plane.

6. An improved exercise device according to claim 4, wherein the right and left distal ends are generally located within corresponding right and left parallel sagittal planes containing corresponding right and left shoulder joint of the user.

7. An improved exercise apparatus according to claim 6, wherein the low friction member further comprises a rotatable pulley, and wherein the flexible cord member is reeved therethrough.

8. An improved exercise device according to claim 6, wherein the low friction member further comprises a polyurethane sliding surface.

9. An improved exercise device according to claim 6, wherein the variable tension device further includes a reel resistance means in frictional contact with the cord member.

10. An improved exercise device according to claim 6, wherein the variable tension device is positioned on the frame member.

11. An improved exercise device according to claim 6, wherein the cord member further comprises a single generally inelastic rope segment, and wherein the hand coupling structure further comprises a pair of hand grips, and wherein each hand grip is coupled to one of the ends of the rope segment.

12. An improved exercise device according to claim 11, wherein the T-shaped frame member further comprises a retractable extension arm for selectively adjusting at least one of the distal ends of the frame member.

13. An improved exercise device according to claim 1, further comprising a cord length adjusting device for selectively adjusting a length of the cord.

14. An improved exercise device, comprising:

a belt device, said belt device being secured generally proximate the waist of a user;

a frame member coupled to the belt device, said frame member being generally T-shaped including a central trunk portion and a pair of extending arms, wherein the frame member extends rearwardly from the belt portion and further includes a distal end on each extending arm, and wherein the distal ends are located away from the belt device and at a predetermined distance below the waist of the user;

a flexible cord of a predetermined length;

a hand coupling device configured to be manipulated by at least part of users hand, said hand coupling device being secured to the flexible cord;

a variable resistance device in frictional contact with the cord for opposing exercise movement of the hand coupling device during exercise use; and a pair of low friction elements disposed at the distal ends of the frame member and forming paths for the cord, whereby during exercise use, forces are generally directed to the distal ends of frame member.

15. An improved exercise device according to claim 14, wherein the distal ends are approximately 5–10 inches below waist of the user.

16. An improved exercise device according to claim 14, wherein the frame member further comprises opposed right and left distal ends, wherein the right and left distal ends are generally located within corresponding right and left parallel sagittal planes containing corresponding right and left shoulder joints of the user.

* * * * *